US005274958A

United States Patent [19]

Brothers et al.

[11] Patent Number: 5,274,958

[45] Date of Patent: Jan. 4, 1994

[54] SHARPENING SYSTEM ESPECIALLY SUITABLE FOR SPIRAL MEAT SLICING BLADE

[75] Inventors: Daniel L. Brothers, Chamblee; Glenn L. Tennell, III, Lawrenceville, both of Ga.

[73] Assignee: The Original Honey Baked Ham Co. of Georgia, Inc., Atlanta, Ga.

[21] Appl. No.: 687,564

[22] Filed: Apr. 19, 1991

[51] Int. Cl.[5] ..... B24B 3/40

[52] U.S. Cl. ..... 51/74 BS; 51/102; 51/3

[58] Field of Search ..... 51/74

[56] References Cited

U.S. PATENT DOCUMENTS

| | | | |
|---|---|---|---|
| 895,749 | 8/1908 | Gury . | |
| 2,470,022 | 5/1949 | Decicco | 51/181 R |
| 3,755,971 | 9/1973 | Garcia | 51/92 BS |
| 3,883,995 | 5/1975 | Ohashi | 51/91 BS |
| 3,885,352 | 5/1975 | Juranitch | 51/92 BS |
| 4,050,370 | 9/1977 | Schmidt et al. | 99/538 |
| 4,265,146 | 5/1981 | Horrell | 76/82.1 |
| 4,546,576 | 10/1985 | Dreiling | 51/372 |
| 4,635,402 | 1/1987 | Sakabe et al. | 51/74 BS |
| 4,961,288 | 10/1990 | Ketteringham | 51/92 BS |

FOREIGN PATENT DOCUMENTS

| | | | |
|---|---|---|---|
| 0393829 | 6/1933 | United Kingdom | 51/102 |

*Primary Examiner*—Robert A. Rose

*Attorney, Agent, or Firm*—Mason, Fenwick & Lawrence

[57] ABSTRACT

The present invention provides a blade sharpening system in which a cylindrical drum abrasive is fitted snugly about a rotatable drum. The blade is run across a guide plate which is maintained at a proper orientation with respect to the drum as the edge of the blade is sharpened on the abrasive. The drum abrasive is maintained at a constant radius, thereby assuring that the contact surface between the blade and the abrasive surface is substantially constant, even after a substantial number of blades are sharpened. Further, an adjustable blade tensioner assembly is provided for substantially continuously maintaining a proper amount of pressure between the blade and the abrasive surface, reducing blade chatter, allowing a rapid but accurately repeatable sharpening process.

15 Claims, 5 Drawing Sheets

SHARPENING SYSTEM ESPECIALLY SUITABLE FOR SPIRAL MEAT SLICING BLADE

BACKGROUND OF THE INVENTION

1. Field of the Invention

The present invention relates to blade sharpening systems. More specifically, the invention relates to systems for sharpening spiral meat slicing blades.

2. Related Art

The spiral meat slicing blade disclosed in U.S. Pat. No. 4,050,370 (Schmidt et al.) has normally been sharpened on a sharpening device employing a stone sharpening abrasive. A significant disadvantage of this device is that, with continued sharpening, the radius of the sharpening abrasive is reduced. This reduced radius causes unreliable sharpening results due to the progressive change in contact area between the blade and the abrasive as the abrasive wears down. Further, the life of the blade is reduced when the contact area is changed through the reduced radius of the abrasive.

There is therefore a need to provide a system of sharpening blades in which the contact area between the blade and the abrasive is maintained substantially constant, even after large numbers of blades have been sharpened.

Another problem of known blade sharpening systems involves "blade chatter". Blade chatter is encountered when a blade being sharpened does not continually and smoothly contact the abrasive surface. Rather, the blade "jumps" periodically or aperiodically from the abrasive surface. Thereafter, a returning force must be applied (such as by a human applying pressure with his hand) to cause the blade to again contact the abrasive surface. This repetition of periods of contact, followed by periods of lesser contact or no contact, causes unevenness of blade sharpening.

Further, known methods of holding the blade against the abrasive surface have often caused either too little pressure or too much pressure between the blade and the abrasive surface. An improper amount of pressure causes blade sharpening to be unreliably sharpened, causing poorer cutting performance.

Therefore, there is a need to provide a blade sharpening system in which a proper amount of pressure is maintained between the blade and the abrasive surface, to reduce blade chatter.

Various blade sharpening systems are known in the art. For example, U.S. Pat. No. 4,635,402 (Sakabe et al.) discloses a knife sharpening apparatus for sharpening blades that are located on the periphery of a drum-shaped cutter used for shredding material (such as tobacco leaves) which are input to a shredding port. An abrasive wheel has a "plane" which rotates to grind a blade edge in a substantially longitudinal direction on the blade, so that it does not become serrated. The abrasive "plane" is not truly a plane, but is curved so as to conform to the cylindrical outer surface of the blade cylinder. This observation applies to other embodiments of the Sakabe et al. device.

U.S. Pat. No. 4,265,146 (Horrell) discloses a device for sharpening lawn mower blades which uses a disk-shaped abrasive wheel adapted for rotation by a standard hand drill. A clamp grasps the blade and allows it to reciprocate, in contact with the abrasive wheel. The Horrell patent discloses two angular orientations of the blade with respect to the abrasive wheel.

U.S. Pat. No. 3,883,995 (Ohashi) discloses a device for sharpening razor blades or scissors in which the razor blade is positioned above a cylindrical abrasive element and moved by a block.

U.S. Pat. No. 3,755,971 (Garcia) discloses a device for grinding sheers and scissors in which a grinding wheel is disposed at 5–25 degrees from the vertical (preferably 20 degrees). With the scissor blade secured to a platform, the platform assembly and scissor blade reciprocate in a direction so that the scissor blade contacts the grinding wheel at an oblique angle.

U.S. Pat. No. 895,749 (Gury) discloses a device for sharping both edges of a blade, the blade being attached to a longitudinally moveable rod so that the two edges of the blade may contact the periphery of cylindrical grinding wheel at a right angle.

The above systems do not enjoy the advantages possessed by the present invention in providing a constant contact surface between blade and abrasive, or in solving blade chatter problems. Some of these patents do not even relate to sharpening the type of blade on which the present invention is most advantageously used. Therefore, there is a need in the art to provide a blade sharpening system which overcomes the above limitations of known blade sharpening systems.

SUMMARY OF THE INVENTION

The present invention overcomes the disadvantages of known blade sharpening systems.

The present invention provides a blade sharpening system in which a cylindrical drum abrasive is fitted snugly about a rotatable drum. The blade is run across a guide plate which is maintained at a proper orientation with respect to the drum as the edge of the blade is sharpened on the abrasive. The drum abrasive is maintained at a constant radius, thereby assuring that the contact surface between the blade and the abrasive surface is substantially constant, even after a substantial number of blades are sharpened.

Further, an adjustable blade tensioner assembly is provided for substantially continuously maintaining a proper amount of pressure between the blade and the abrasive surface, reducing blade chatter, and allowing rapid but accurately repeatable sharpening process.

BRIEF DESCRIPTION OF THE DRAWINGS

The invention is better understood by reading the following Detailed Description of the Preferred Embodiments with reference to the accompanying drawing FIGURES, in which like reference numerals refer to like elements throughout, and in which:

FIG. 1A is a side elevation emphasizing an angle $\phi$, and FIG. 1B is a top view emphasizing an angle $\theta$.

DETAILED DESCRIPTION OF THE PREFERRED EMBODIMENTS

Figure 1:
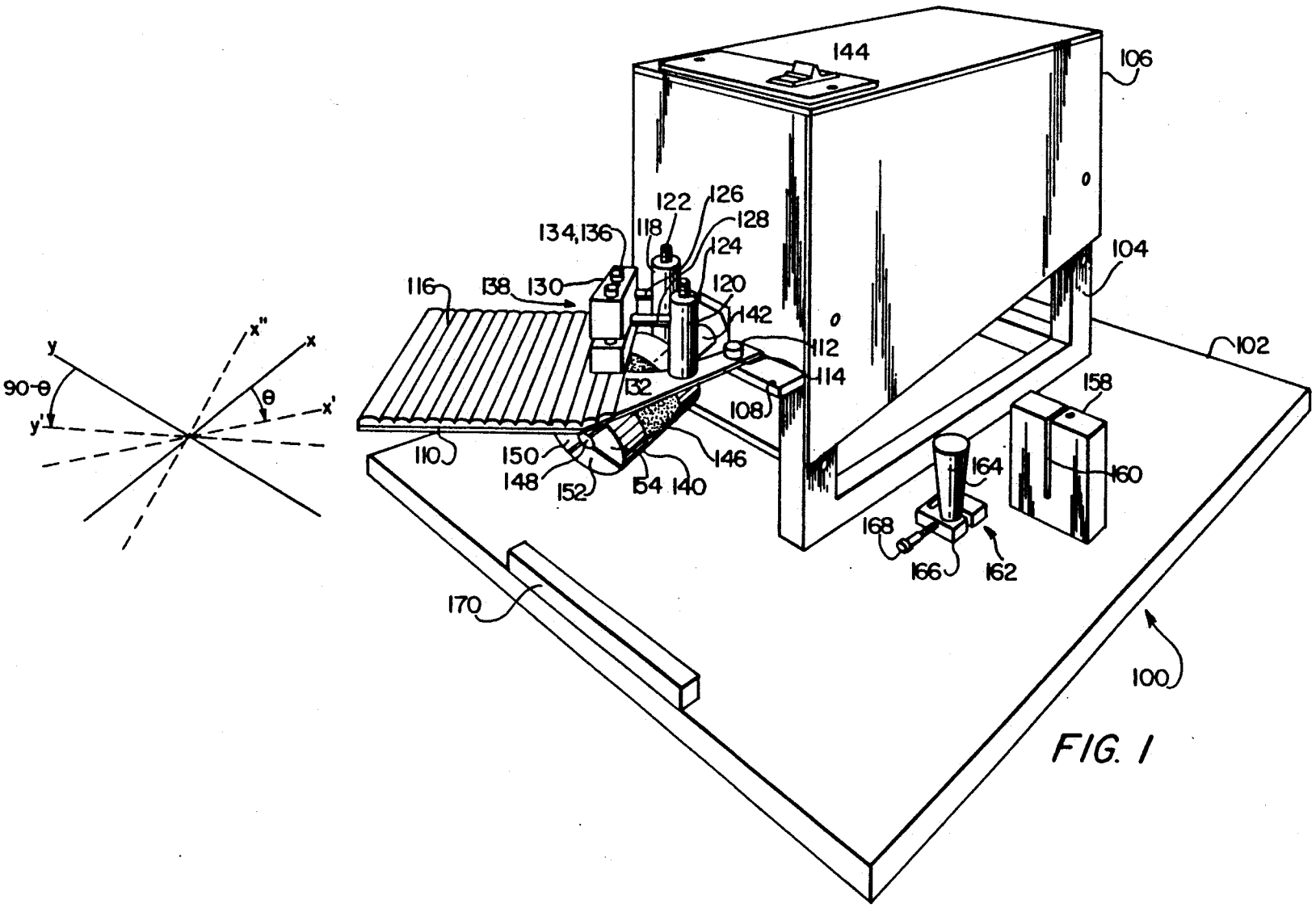
FIG. 1 is a perspective view of a preferred embodiment of the blade sharpening system according to the present invention.
Figure 1A:
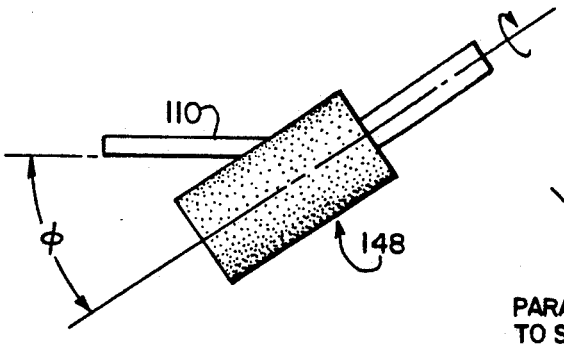
FIGS. 1A and 1B illustrate the orientation of the guide plate with respect to the abrasive medium on drum 140 (FIG. 1). In particular.
Figure 1B:
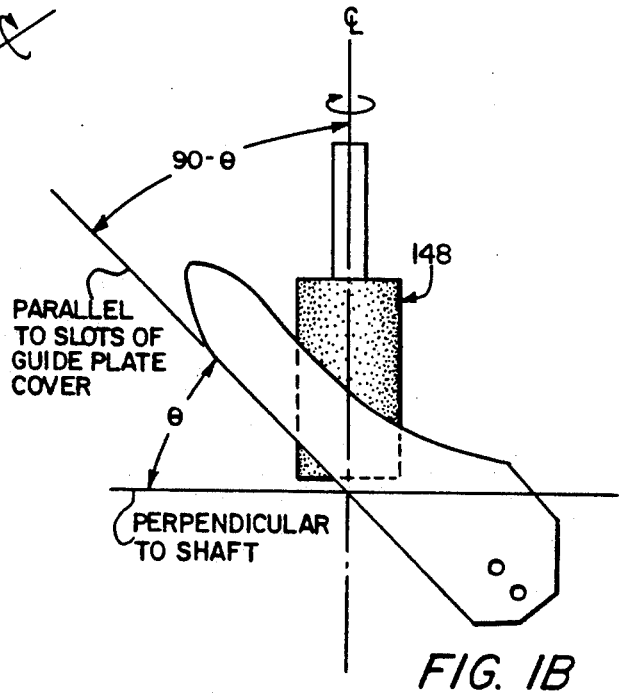

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose. Further, descriptive spatial terms such as "upper", "lower", "left", "right", "horizontal", "vertical", "clockwise", "counterclockwise", and so forth, are presented for ease of explanation, and do not limit the invention.

FIG. 1 illustrates in perspective view a preferred embodiment of the blade sharpening system 100 according to the present invention.

System 100 includes a base 102 which supports a motor housing frame 104 which in turn supports motor housing 106. Motor housing frame 104 includes a frame ledge 108. Frame ledge 108 is a horizontal planar structure projecting outward from motor housing 106. The frame ledge 108 is provided with vertical holes through which suitable attachments means may secure a horizontally oriented guide plate 110. In the FIG. 1 embodiment, guide plate 110 is affixed to the top of frame ledge 108 by means of a nut 114 and bolt 112, as well as a bolt running through a riser 118. A planar guide plate cover 116, provided with parallel visual alignment lines on its top surface, is affixed to the top surface of guide plate 110.

Guide plate 110 is a "C"-shaped planar structure. On respective legs of the "C", two cylindrical risers 118, 120 extend upward. Risers 118, 120 include respective set screws 122, 124 inserted axially therein. Parallel cylindrical tensioner support arms 126, 128 extend horizontally, projecting radially from respective risers 118, 120. The tensioner support arms 126, 128 extend to hold a rectangular tensioner support 130.

Tensioner support 130 is loosely joined to a tensioning foot 132 in a manner to be described in greater detail below, with special reference to FIG. 3. Briefly, however, slide guides 134, 136 penetrate vertical, unthreaded holes in the tensioner support 130 but are affixed to tensioning foot 132. Tensioning means (such as a pair of springs surrounding the slide guides 134, 136 between the tensioner support 130 and the tensioning foot 132) force the tensioning foot 132 downward, in the direction of guide plate cover 116. Collectively, elements 130, 132, 134, 136 and associated elements are referred to in this specification as a blade tensioner assembly 138.

During the sharpening process (described with reference to FIGS. 9A to 9D), the blade is inserted horizontally between the tensioning foot 132 and the guide plate cover 116. The blade is maintained against the guide plate cover by downward pressure of the springs.

Beneath the guide plate 110 and blade tensioner assembly 138, a cylindrical drum 140 is adapted to rotate with a shaft adapter 142 extending between the drum and the motor within motor housing 106. The motor is activated by a suitable switch, such as that indicated at 144. Any suitable motor may be employed in motor housing 106 to turn the drum 140, such as model No. 307 available from MAGNATEK UNIVERSAL ELECTRIC of Owosso, Michigan. Preferably, a pillow block bearing is used with the motor and shaft adapter.

A hollow cylindrical drum abrasive 146 fits tightly about drum 140. The tightness of the drum abrasive 146 about drum 140 is assured by a drum plug 148. Drum plug 148 threadably engages drum 140 in its axis, spreading apart drum sectors which comprise the drum 140. In FIG. 1, three drum sectors 150, 152 and 154 are visible. Drum plug 148 threadably engages the drum 140, the drum sectors 150, 152, 154 . . . expand away from the axis of drum 140, firmly grasping cylindrical drum abrasive 146.

It is desirable that the drum abrasive not be stretched outward by the pressure of the sectors, so that the radius of the grinding surface remain constant. A preferred drum abrasive is 80 grit aluminum zirconia for initial profiling to prevent blade damage, and 120 grit silicon carbide for sharpening.

The illustrated embodiment further includes a steeling jig 158 which includes a jig slot 160. The steeling jig 158 is attached to base 102 at a location facilitating the steeling and honing of a blade after it has been sharpened on drum abrasive 146.

During the sharpening and steeling processes, the blade is held by a blade handle assembly generally indicated as 162. Blade handle assembly 162 includes a handle 164 to whose lower end is attached a blade clamp 166. As will be described in greater detail below, with reference to FIGS. 7A, 7B, and 8, a clamp screw 168 allows the blade to be secured to the blade clamp 166.

A rectangular wiping block 170 is provided for wiping the blade of burrs after sharpening and steeling. wiping block 70 may be made of pine wood or other suitable material.

Guide plate 110 is illustrated in FIG. 1 in a substantially horizontal orientation, with the axis of drum 140 sloping downward at an angle $\phi=23°$. More generally, the guide plate is preferably oriented as follows for sharpening of the blade disclosed in U.S. Pat. No. 4,050,370 (Schmidt et al.).

For the present discussion, it is assumed that the X axis in three-dimensional Cartesian coordinates is parallel to the axis of the drum 140. The Y direction is assumed to be perpendicular to the X direction, and lies in a horizontal plane. The initial position of the guide plate is assumed to be in the X-Y plane, with the guide plate cover grooves initially parallel to the drum axis.

The side of guide plate 110 nearest the motor (edge 216 in FIG. 2) is rotated downward about the Y axis an angle $\phi$ which, in the preferred embodiment, is 23°. As shown in FIG. 1, this rotation causes the X axis to be rotated to the X' axis, the X' axis being horizontal. After this first rotation, the X' and the Y axes are in a horizontal plane.

Guide plate 110 is then rotated horizontally in a counter-clockwise direction (viewed from above) by an angle (90−θ), θ being an angle which in the preferred embodiment is 38°. After this rotation, the X' and Y axes are translated to the X' and Y' axes, which are in horizontal plane.

In FIG. 1, the guide plate cover 116 is shown oriented in the horizontal plane when it is in its "final" position. The guide plate cover's visual alignment lines are parallel to the X' axis and perpendicular to the Y' axis.

The foregoing description describes the spatial orientation of the guide plate 110 and guide plate cover 116 with respect to the drum 140. Of course, this description is intended to convey the orientation of a preferred design, and not steps which an operator would have to go through in physically adjusting the guide plate before a sharpening operation. Rather, it is preferable that the guide plate 110 be designed to be permanently or fixedly attached to the frame ledge 108 at the desired orientation in three-dimensional space, so that reproducible and accurate sharpening results are obtained. However, it also lies within the contemplation of the present invention that the orientation of guide plate 110 may be changed after manufacture of the blade sharpening system, allowing different blade types, or different angles of attack of an abrasive on a given blade type, to be possible. The FIG. 1 embodiment is thus illustrative of a system believed to optimally sharpen spiral meat slicing blades such as that described in U.S. Pat. No. 4,050,370 (Schmidt et al.), but the invention need not be limited to such geometry or application.

Figure 2A:
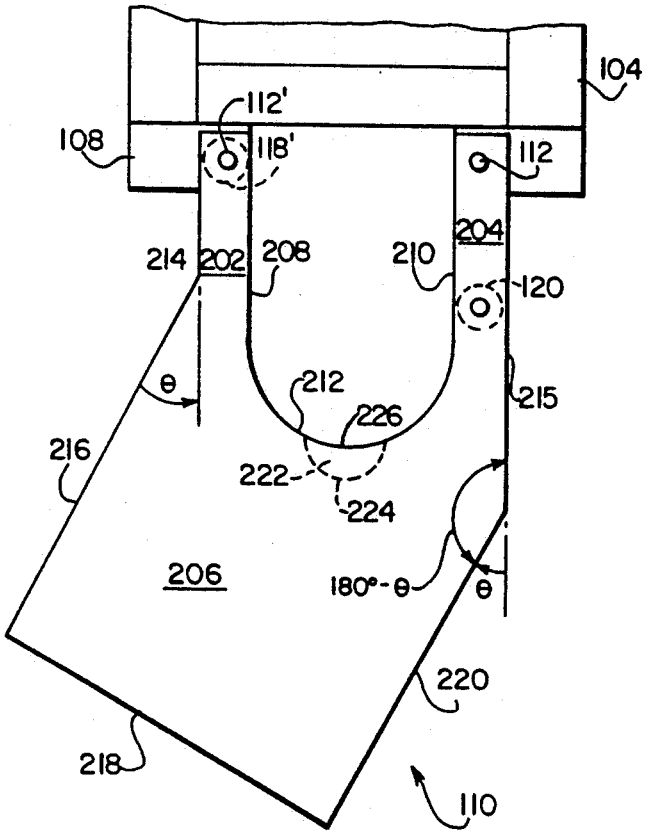
FIGS. 2A and 2B rates a preferred embodiment of the guide plate 110 illustrated in FIG. 1.
Figure 2B:
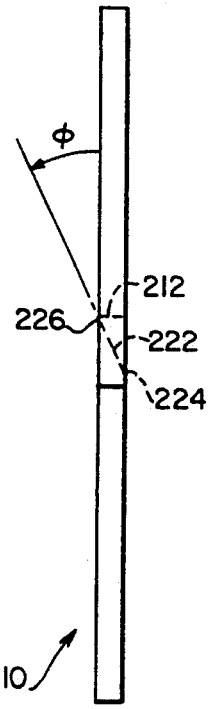

FIG. 2 illustrates the guide plate 110 which was partially obscured in the perspective view of FIG. 1. For purposes of illustration, the grooved guide plate cover 116 (FIG. 1) is purposely omitted in FIG. 2. FIG. 2 illustrates the attachment of guide plate 110 to frame ledge 108 by bolts 112 and 112'. Risers 118, 120 (FIG. 1) are attached to the guide plate 110 at points 118', 120', respectively.

The guide plate 110 is essentially a "C"-shaped planar metal element including short tongue 202 and long tongue 204 extending from the ledge 108 to a guide plate main area 206 connecting the ends of the two tongues furthest from the motor. The space inside the "C" is bounded by inner surfaces 208, 210 of respective tongues 202 and 204. Inner surfaces 208 and 210 are joined by a semi-circular surface 212 defining the inner boundary main area 206. Surfaces 208, 210, 212 thus form a rounded "U" shape having an open end traversed by the motor housing.

Suitable dimensions -may be chosen as follows. In a preferred embodiment, the center of curvature of the semi-circular surface 212 is 2.1 inches from the ends of tongues 202, 204. The radius of curvature of the semi-circular surface is 1.1 inches. Tongues 202, 204 are each 0.6 inches wide.

Tongues 202, 204 have respective outer surfaces 214, 215 having respective lengths 0.6 inches and 4.0 inches. Guide plate main area 206 includes three consecutive linear outside edges 216, 218, 220 which connect tongue outer surfaces 214 and 216. Outer surface 214 forms an angle (180−θ)° with outer surface 216. In the preferred embodiment, the angle θ is 38°, corresponding to the angle θ shown in FIG. 1.

Outer edge 216 extends approximately 4.65 inches to form a right angle with outer edge 218. Outer edge 218 extends approximately 4.75 inches to form a right angle with outer edge 220. Outer edge 220 extends approximately 4.1 inches to form an inner angle (180−θ) with outer edge 215. In the preferred embodiment, this θ is preferably 38°, and corresponds to the angle θ described above, with reference to FIG. 1. In this manner, outer surfaces 216 and 220 are essentially parallel. It is understood that the linear dimensions of the outer surface are close approximations only, the essential dimensions of the outer surfaces being determined in accordance with the angle θ which is determined by the desired angle of motion of the abrasive with respect to the blade being sharpened.

FIG. 2 also illustrates how a hollowed wedge is formed by a taper 222 formed on the bottom side of guide plate 110. The hollowed wedge is centered at the point on semi-circular surface 212 which is farthest from the frame 104. The full thickness of the guide plate main area 206 is found at the edge 224 of the taper 222. However, approaching semi-circular surface 212, the hollowed wedge is formed so that a linear approach to the top surface of the semi-circular surface is made. In the preferred embodiment, the surface of the wedge makes an angle θ with the top of the guide plate. In the preferred embodiment, θ is 23: This angle θ corresponds to that described above, with reference to FIG. 1.

Guide plate cover 116 (not illustrated in FIG. 2) is affixed securely atop the guide plate, on the side of the guide plate opposite that on which the taper is machined. When the taper is machined according to the above specifications, the taper extends through the guide plate cover so that the rotating drum is close to the guide plate cover without touching it.

The purpose of this wedge being formed in the underside of guide plate 110 and in the edge of the guide plate cover 116 is to allow the drum 140 and drum abrasive 146 (FIG. 1) to fit close to the underside of the guide plate 110 without contacting it. Thus, as the blade is supported above guide plate 110 on guide plate cover 116, the edge of the blade contacts the abrasive 146 in the rounded "U"-shaped area immediately above the zone defined by inner surfaces 208, 210 and 212 (FIG. 2).

The guide plate cover 116 (FIG. 1) is securely but removably affixed to the top surface of guide plate 110. The guide plate cover 116 may be attached to the guide plate 110 by, for example, a set of four screws located near the four corners of the guide plate cover, 0.5 inches from its outer edges. The guide plate cover is preferably 4.75 by 4.5 inches, with a notch cut in the corner to allow it to match the outer contour of outer surface 204.

The guide plate cover 116 preferably includes a set of equally spaced, parallel visual alignment indicators. In the preferred embodiment, the parallel alignment indicators are V-shaped grooves at 0.25-inch spacing parallel to outer edge 218 of the guide plate 110. Preferably, the V-shaped grooves have an inner angle of 90° , so that the faces of the groove make respective angles of 135° with respect to the flat top surface of the guide plate cover.

The grooves in the top surface of the guide plate cover facilitate an individual's alignment of a first ("back") edge of the blade while sharpening the "sharp" edge of the blade. Other methods of assisting the individual in properly aligning the blade lie within the contemplation of the invention, but such grooves provide the advantage that small bits of debris fall within the grooves to prevent them f rom undesirably altering the angle of attack of the blade while it is being sharpened.

Figure 3:
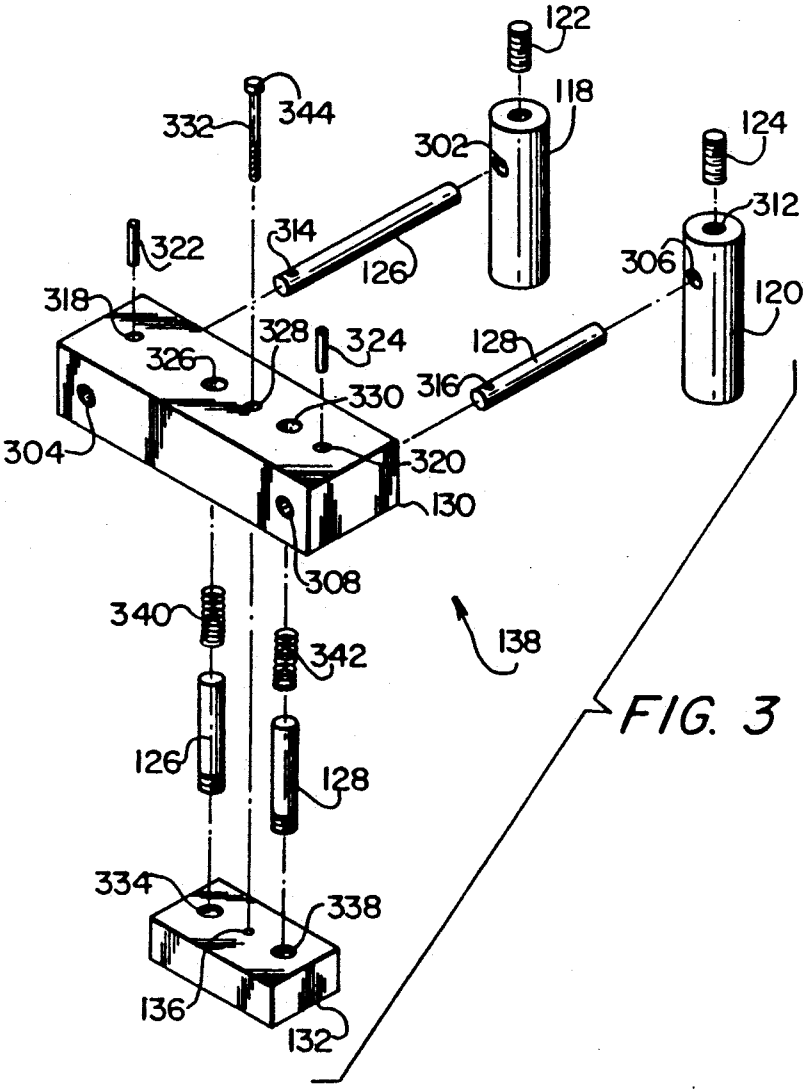
FIG. 3 is an exploded perspective view of the blade tensioner assembly 138 illustrated in FIG. 1.

Referring now to FIG. 3, the tensioner assembly 138 of FIG. 1 is illustrated in an exploded perspective view.

Stationary portions of the tensioner assembly include tensioner risers 118, 120, set screws 122, 124, tensioner support arms 126, 128, and tensioner support 130. As described with reference to FIG. 1, tensioner risers 118, 120 are securely affixed to the guide plate 110 at points 118', 120' (FIG. 2).

Tensioner support arm 126 extends from a circular radial aperture 302 in riser 118 through a cylindrical aperture 304 in tensioner support 130. Similarly, tensioner support arm 128 extends from a cylindrical radial aperture 306 in riser 120 through a cylindrical aperture near an end of tensioner support 130 opposite to that of aperture 304. After tensioner support arms 126, 128, are inserted into cylindrical radial apertures 302, 306, respectively, set screws 122, 124 are screwed into threaded holes 310, 312 along the axial direction of the risers. Set screws 122, 124 press against the top surfaces of the tensioner support arms 126, 128 within the tensioner risers 118, 120, respectively. The set screws thus hold the tensioner support arms in place, but allow adjustment of the position of the tensioner assembly, for example, for different blade types.

The tensioner support arms 126, 128 are affixed to the tensioner support 130 in the following manner. Tensioner support arms 126, 128 are provided with respective vertically oriented, radial apertures 314, 316. Support arms 126, 128 are inserted into respective tensioner support apertures 304, 308 so that apertures 314, 316 align with apertures 318, 320 which are bored vertically into the top surface of the tensioner support 130. Then, dowels 322, 324 are inserted through respective apertures 318, 320 and 314, 316, thereby securing the tensioner support arms 126, 128 with respect to the tensioner support 130.

Tensioner support 130 is further provided with three vertically bored holes 326, 328, and 330. Holes 326, 328, and 330 are not threaded but allow free but snugly guided movement of slide guide 126, a socket cap screw 332, and slide guide 128, respectively.

Tensioning foot 132 is a substantially rectangular structure provided with three threaded vertical holes 334, 336, and 338. These holes 334, 336, 338 correspond to respective holes 326, 328, 330. Slide guides 126, 128 are threaded into holes 334, 338, respectively. Helical springs 340, 342 are placed around the cylindrical surfaces of slide guides 126, 128. Screw 332 is inserted through unthreaded hole 328 and is then threaded into hole 336 in the tensioning foot. This threading action draws tensioner support 130 closer to the tensioning foot 132, and slide guides 126, 128 penetrate and remain within holes 326, 330 in the tensioner support 130.

Stationary tensioner support 130 forces movable tensioning foot 132 away by the helical springs 340 and 342. Tensioner support 130 and tensioning foot 132 are pressed apart to a limit determined by a cap 344 on the end of socket cap screw 332. When springs 340, 342 push tensioning foot 132 far enough to cause cap 344 to contact the top surface of tensioner support (or any countersink in it), the limit of separation is reached.

In operation, the blade to be sharpened is placed beneath tensioning foot 132. The blade may be lifted against the pressure of springs 340, 342. However, the expansive force of springs 340, 342 tends to force the tensioning foot against the blade, in turn applying force against it down toward guide plate cover 116 (FIG. 1). Any "blade chatter" which is experienced is reduced by the shock-absorption function of springs 340, 342 pressing downward against tensioning foot 132.

The tensioner assembly is adjustable in a number of ways.

First, the vertical displacement of tensioning foot 132 from tensioner support 130 is determined in accordance with the depth to which screw 332 is threaded into hole 336. In a preferred embodiment, screw 332 is preferably adjusted using a Hex wrench. By threading screw 332 further into hole 336, the separation of tensioner support 130 and tensioning foot 132 is reduced, with a corresponding increase in the expansive force of springs 340, 342. In the preferred embodiment, screw 332 is adjusted so that the separation of tensioner support 130 and tensioning foot 132 allows there to be a slight resistance when the blade is beneath the tensioning foot. The springs 340, 342 are preferably LC-038G-1 (Lee Spring Company, Brooklyn, New York) or equivalent, 0.5 inches in free length, 0.144 inches solid height (compressed length), with a 20 pounds per inch spring constant.

The tensioning assembly 138 is also adjustable by moving tensioner support arms 126, 128 different distances through apertures 302, 306 in tensioner risers 118, 120, respectively. As the tensioner support arms 126, 128 are inserted farther into the apertures 302, 306, the tensioner assembly 138 is brought closer to the risers 118, 120. This allows adjustability of where the tensioner assembly contacts the top surface of the blade as it is being sharpened. To sharpen a narrower blade, the tensioner support arms 126, 128 should be further inserted into the apertures 302, 306, than for wider blades. This demonstrates how a variety of blade types may be sharpened by the present invention.

In the preferred embodiment, tensioner support 130 may be dimensioned as follows. Tensioner support 130 may be 3.88 inches long, 0.75 inches wide and 0.75 deep (vertically). Horizontal holes 304, 308 may be 0.375-inch diameter holes centered approximately 0.375 inches from respective ends of the tensioner support 130. Vertical dowel apertures 318, 320 may be bored 0.375 inches from respective ends of the tensioner support, 0.125 inches in diameter. Vertical aperture 330 may be centered 0.5 inches from the center of aperture 320. Apertures 326, 328, and 330 may be centered 0.42 inches apart from one another. Aperture 328 may include a cylindrical countersink zone to receive cap 334 of screw 332. The countersunk portion may be 0.375 inches in diameter and 0.25 inches deep,, with the remaining portion of aperture 328 (for receiving the shaft of the screw 332) being 17/64 inches in diameter.

Apertures 326, 330 may be drilled approximately 25/64 inches in diameter, to receive slide guides 126, 128. Slide guides 126, 128 are preferably 0.375-inch diameter 1018 C.R. cylinders with 1.75-inch overall length, the bottom 0.375 inches being threaded. Tensioner support 130 itself is preferably made of DELRIN TM.

The tensioning foot 132 may be dimensioned as follows. The tensioning foot may be 1.65 inches long, 0.75 inches wide (along its horizontal dimension, perpendicular to threaded holes 334, 336, 338), and 0.5 inches thick (vertically, parallel to the threaded holes). Threaded apertures 334, 338 are drilled and tapped for ⅜-16 dimensions through the thickness of the tensioning foot. Similarly, aperture 336 is drilled and tapped to size ¼-20 through the tensioning foot's thickness. Preferably, the tensioning foot's two vertical corner edges farthest f rom risers 118, 120 may be rounded using a fillet having a center of curvature in apertures 334, 338, and having a radius of curvature of 0.375 inches. The tensioning foot is preferably made of DEIRIN7 TM.

Tensioner risers 118, 120 may be made of 1018 C.R., 2.04 inches in overall length and 0.75 inches in diameter. Apertures 302, 306 may be 0.375 inches in diameter, centered 1.54 inches above the lower edge of the tensioner risers. Threaded apertures 310, 312 may be threaded to size ¼-20 to a depth of 0.5 inches, the level of the center of holes 302, 206. The tensioner risers may be affixed to the guide plate 110 by bolts inserted through holes in the guide plate and into a threaded aperture (not illustrated) in the bottom of the riser.

Figure 4B:
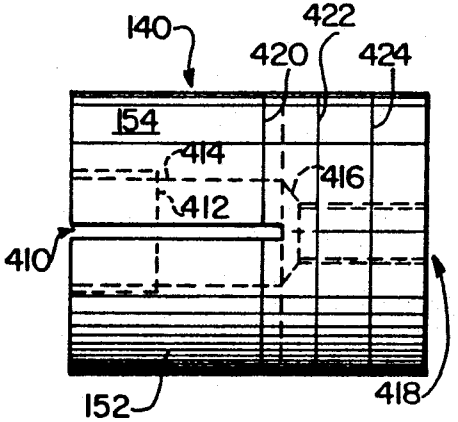
FIGS. 4*a* and 4*b* illustrates in greater detail the structure of the drum 140 in FIG. 1.
Figure 4A:
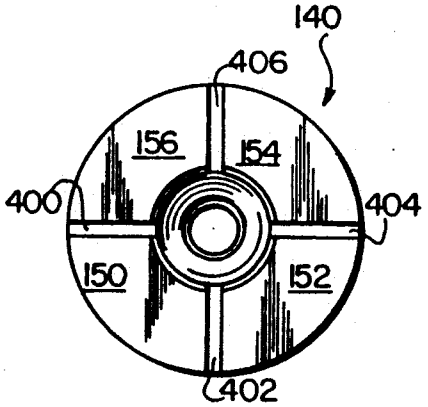

FIG. 4 illustrates a preferred embodiment of the drum 140 (FIG. 1). As shown in FIG. 4, the drum includes, at a first end, four drum sectors 150, 152, 154, and 156. The drum sectors are separated by slots 400, 402, 404, and 406. A first hole 410 is formed axially along the drum. Hole 410 includes a 0.625-inch deep first threaded area 412 and an unthreaded area 414. Unthreaded area 414 is the tap drill diameter, and extends 1.5 inches from the first end of the drum. Hole 410 terminates in a chamfered area 416. A second hole 418 extends axially from a second end of the drum to complete the inner circular edge of chamfer 416.

In the preferred embodiment, the drum is made of 2-inch outside diameter high density plastic, 2.5 inches in length. Slots 400, 402, 404, and 406 extend 1.5 inches from the end of the drum, and are 0.125 inches wide, dividing the drum into 4 sectors of equal angular extent.

Threaded area 414 of hole 410 is threaded to size ¾-14 NPT. Thus, the threads being tapered so that as the drum plug is screwed into the opening 410, the effective outside diameter of the threaded area changes so that sectors 150, 152, 154, 156 are spread apart.

Hole 418 is drilled and tapped to size ½-13, extending inwardly one inch from the second end of the drum.

Along the outer periphery of the drum are three circular grooves 420, 422, 424. In cross-section, the grooves present a semi-circular indentation of 0.01-inch radius. The circular grooves are located 0.375 inches, 0.75 inches, and 1.125 inches, from the second end of the drum. The purpose of the circular grooves 420, 422, 424 is to allow the operator to align the end of the abrasive at several positions along the outside of the drum. These alignments allow the same abrasive to be used a number of times, with a different "ring" being used to contact the blade with different positions of the abrasive on the drum.

In operation, a drum plug 148 (FIG. 1) is threaded into the threaded area 414 of the drum, causing drum sectors 150, 152, 154, and 156 to expand to grasp a hollow cylindrical drum abrasive 146 (FIG. 1). In the preferred embodiment, the plug is simply a ¾-14 NPT pipe plug. As illustrated in FIG. 4, the outward pressure of the drum sectors against the inner surface of the drum abrasive is effective only in the 1.5 inches to which hole 410 is drilled.

Advantageously, the illustrated arrangement allows the drum abrasive 146 to be moved along the axial direction of drum 140, exposing different "rings" on the abrasive to the blade's edge. In this manner, the lifetime of a single cylindrical drum abrasive is multiplied, as the abrasive may be considered a collection of several adjacent "rings".

Figure 5:
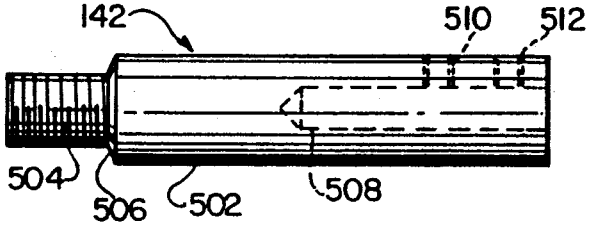
FIG. 5 illustrates a shaft adapter useful in joining the drum 140 to the motor in accordance with a preferred embodiment.

FIG. 5 illustrates a preferred shaft adapter 142 used for insertion into the drum hole 413 (FIG. 4). Shaft adapter 142 includes three substantially cylindrical portions 502, 504, and 506. Cylindrical portion 502 is a 3.1-inch long, 0.75 inch diameter cylinder. Portion 504 is located at the opposite end of the shaft adapter 142, is 0.7 inches long and 0.5 inches in diameter, its outer cylindrical surface being threaded to size ½-13 to match aperture 418 (FIG. 4). Cylindrical portion 506 is a clearance groove 0.05 inches in length and 0.41 inches in diameter. The shaft adapter 142 is preferably made of ground and polished EDT 150.

In the end of cylindrical portion 502, an axial hole 508 is drilled 0.312 inches in diameter, 1.75 inches along the axial dimension. Two radial holes 510, 512 are drilled and tapped to size #10-24, to the center of cylindrical portion 502, the holes being 0.25 and 0.75 inches from the end of the cylindrical portion 502. Holes 508, 510, 512 allow attachment of the shaft adapter 142 to the motor shaft received in hole 508, preferably by two #10-24 set screws.

Any suitable motor may be employed to power the drum. Further, it has been found advantageous to use a pillow block bearing mounted to a plate which is in turn mounted to a frame so that the forces encountered during sharpening are applied to the pillow block, not to the motor bearings. The pillow block thus reduces wear on the motor bearings, extending its useful life.

The axis of the drum points downward 23° from the horizontal. This angle allows convenient and comfortable handling of the blade by the operator.

Figure 6A:
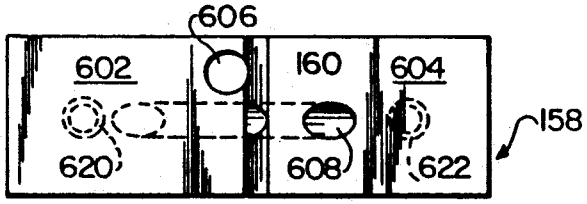
FIG. 6A and 6B illustrates in greater detail the steeling jig 158 shown in FIG. 1.
Figure 6B:
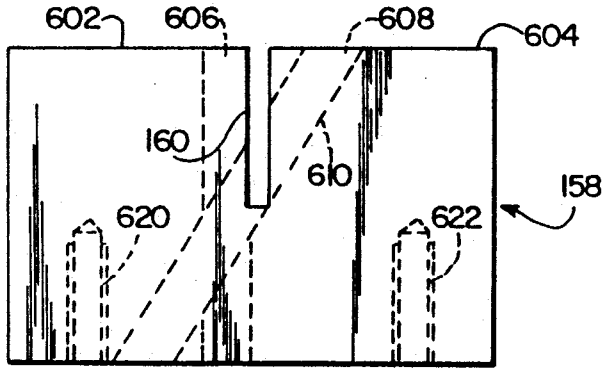

FIG. 6 illustrates the steeling jig 158 previously discussed with reference to FIG. 1. In the illustrated embodiment, steeling jig 158 is a DELRIN7 TM structure 2 inches high, 3 inches wide, and 1 inch deep. Slot 160 extends from the center of the 1×3-inch top of the steeling jig downward 1.0 inch, dividing the top of the steeling jig into first and second top surfaces 602, 604. A first 5/16-inch diameter hole 606 is drilled vertically downward into top surface 602, 0.3 inches from the 2×3 inch rear surface of the jig and 0.116 inches to the left of the center of slot 160. Thus, the radius of hole 606 encompasses a portion of the interior of slot 160.

A second hole 608 is drilled into the top surface 604 at a 30° angle with respect to the vertical, in a plane parallel to the 2×3 inch front and back surfaces of the jig. The center of hole 608 is 0.62 inches to the right of hole 606, but is centered between the two 2×3-inch major planes of the jig. Thus, hole 608, drilled at an angle of 30°, forms a slanted tunnel 610 to intersect the center of slot 160 near its bottom.

Abrasive rods are inserted into holes 606, 608 and contact the blade during the steeling process. Viewed from the side of slot 160, the blade encounters a skewed "V" shape defined by the right surface of the rod inserted in hole 606 and the top surface of rod inserted into hole 608. Preferably, the rod for hole 606 is made of steel with a ceramic coated surface, and the rod for hole 608 is solid, high-end alumina ceramic.

The steeling jig 158 is provided with means of attachment to the base 102 (FIG. 1). Threaded holes 620, 622 are provided 0.5 inches from opposite ends of the steeling jig's 1×2 inch end surfaces, and are adapted to receive threaded bolts fed through holes spaced 2 inches apart in the base 102.

Figure 7A:
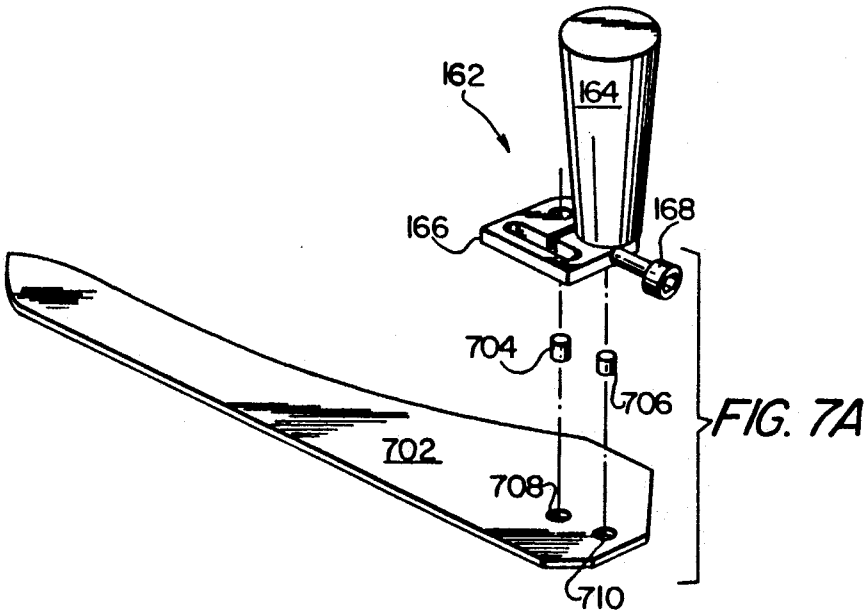
FIGS. 7A and 7B illustrate the handle assembly with a blade in exploded perspective and assembled views.
Figure 7B:
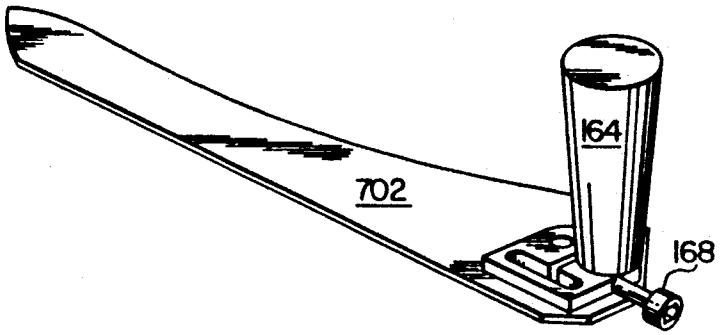

FIGS. 7A and 7B illustrate how a handle may be affixed to a blade to allow a human operator to sharpen the blade, using the preferred embodiment of the blade sharpening device.

Referring to FIG. 7A, a blade 702 is illustrated with a blade handle assembly 162. The blade handle assembly includes a handle 164, blade clamp 166, and a clamp screw 168. Handle 164 is affixed to the blade clamp 166 by means of, for example, a bolt extending through an aperture (not shown) through blade clamp 164 into an axial threaded aperture in the bottom of handle 164.

Cylindrical studs 704, 706, visible here because the assembly is shown in exploded view, extend downwardly from blade clamp 166 through apertures 708, 710, respectively, in the handle end of blade 702. The manner in which the handle assembly 162 is firmly but removably affixed to the blade 702 is described in greater detail below, with reference to FIGS. 8A and 8B.

FIG. 7B illustrates the completed assembly of the blade handle assembly 162 and blade 702. During the sharpening process, the operator grasps the handle to guide the blade into contact with the abrasive surface on the drum, as described below, with reference to FIGS. 9A through 9D.

Figure 8B:
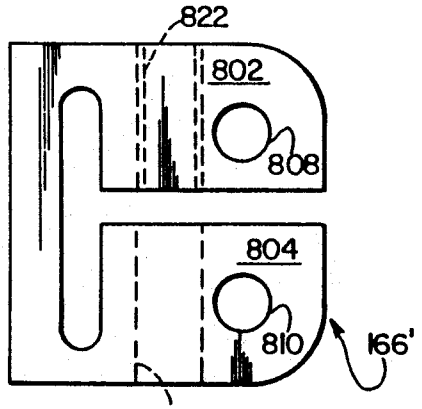
FIGS. 8A and 8B illustrate embodiments of the blade clamp 166 shown in FIG. 1.

Referring now to FIG. 8B, a preferred embodiment of a blade clamp 166 is illustrated in top plan view. The blade clamp is essentially a "C"-shaped planar structure having top arm 802, bottom arm 804, and connecting portion 806. The interior of the "C" is essentially defined by a "T"-shaped hole having a cross bar segment and a perpendicular stem extending in one direction from the center thereof. The cross bar of the "T" is essentially parallel to the connecting portion 806, and the stem of the "T" dividing top and bottom arms 802, 804. Top and bottom arms 802, 804 include apertures 808, 810 adapted to receive studs 704, 706 (FIG. 7A).

In the illustrated embodiment, the "C" of the blade clamp is 1.4 inches wide (parallel to the stem of the "T"), 1.75 inches high, and made of ⅜-inch 6061-T651 aluminum. The outer corners of the cross bar of the "T" are rounded by inner fillets to deconcentrate stress. The cross-bar and stem portions of the "T" are 3/16-inch wide.

The blade clamp 166 is further provided with a tapped hole 812 extending horizontally through the side of lower arm 804 parallel to the major surfaces of the blade clamp and parallel to the cross bar of the "T". The side of top arm 802 facing the stem of the "T" is provided with a conical indentation 814 which is axially aligned with cylindrical hole 812. Together, hole 812 and conical indentation 814 are so configured that when guide clamp screw 168 (FIG. 7A and FIG. 7B) is threaded through hole 812 and engages conical indentation 814, top and bottom arms 802, 804 are spread apart. Studs 704, 706 (FIG. 7A), held within holes 808, 810, are thus pressed outward against the outward sides of blade holes 708, 710, thus securing the blade 702 to the blade clamp 166.

The blade handle assembly may be removed from the blade by unscrewing the clamp screw, causing the pressure of the studs to be released.

Figure 8A:
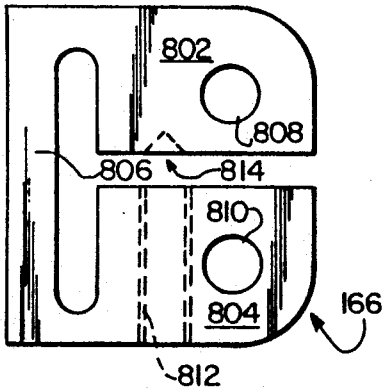

FIG. 8B illustrates an alternative, preferred embodiment 166' of the blade clamp 166 shown in FIG. 8A.

This embodiment is also C-shaped, but a ¼-20 threaded hole 822 is provided in upper arm 802, extending horizontally, parallel to the major surfaces of the blade clamp and parallel to the cross bar of the "T". Lower arm 804 is provided with a 0.302-inch diameter clearance hole 824 which is axially aligned with the threaded hole 822. Together, threaded hole 822 and clearance hole 824 are so configured that when a guide clamp screw is passed through the clearance hole, the guide clamp screw engages the threads of the hole 812.

When the head of the guide clamp screw reaches the outer surface of the blade clamp, the top and bottom arms 802, 804 are pulled toward one another. Studs 704, 706 (FIG. 7A), being held within holes 808, 810, are thus pressed inward against the inner sides of the blade holes 708, 710, thus securing the blade 702 to the blade clamp 166'.

Other features of the construction of the blade clamp 166' are analogous to those of blade clamp 166. However, in a particular preferred embodiment, dimensions are as follows. The blade clamp is 1.4 inches wide, parallel to the stem of the IITII, and 1.75 inches wide parallel to its cross bar. The cross bar of the "T" is centered 0.31 inches from the edge of the clamp. The ends of the cross bar are semicircular inner surf aces of 3/16-inch diameter, the center of the surfaces being 0.375 inches from the outer surfaces of the top and bottom arms. Holes 822, 824 are centered 0.71 inches from the edge of the blade clamp adjacent the cross bar. Of course, variations may be made to accommodate different blade types, in accordance with principles known to those skilled in the art.

FIGS. 9A, 9B, 9C, and 9D illustrate consecutive views demonstrating how a blade 702 may be sharpened, using the blade sharpening apparatus according to the preferred embodiment. FIGS. 9A through 9D further illustrate the manner in which the operator may use the alignment grooves on guide plate cover 116 to assure that the angle of incidence of the abrasive to the blade edge is maintained substantially constant.

Figure 9D:
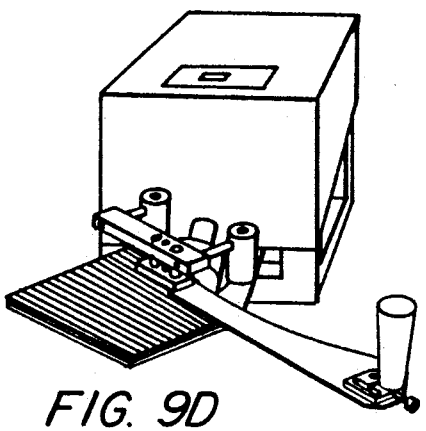
FIGS. 9A through 9D are sequential illustrations of a blade sharpening using the preferred blade sharpening system of FIG. 1.
Figure 9C:
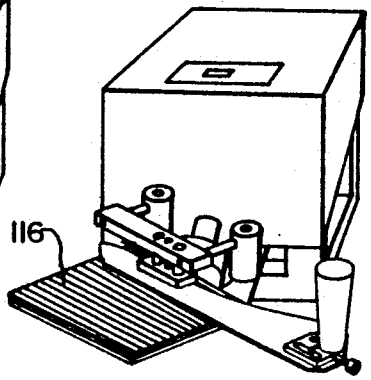
Figure 9B:
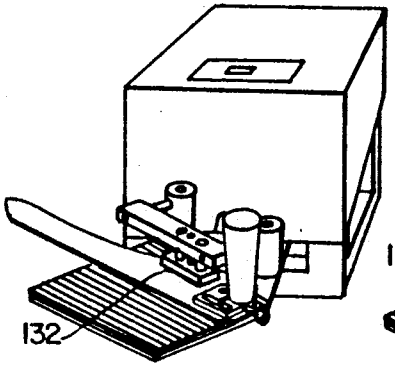
Figure 9A:
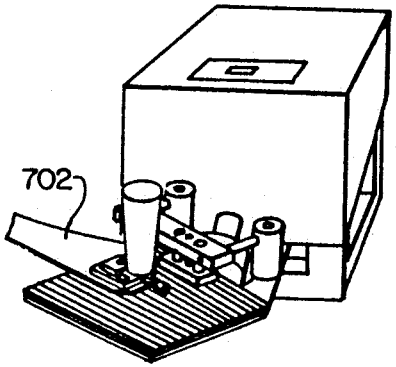

FIG. 9A illustrates the blade near the beginning of the sharpening stroke. FIG. 9B illustrates the blade placed under tensioning foot 132, the blade sharpening process having begun. As shown in FIG. 9C, the blade is further drawn along the top of guide plate cover 116, the right edge of the blade continuing to contact abrasive surface 146 (FIG. 1; not visible in FIGS. 9A-9D). Finally, FIG. 9D illustrates the blade after completion of a given sharpening operation.

The sequence of FIGS. 9A through 9D is repeated several times, as needed, during each of the profiling and sharpening operations. Between the profiling and sharpening operations, the abrasive may be replaced.

Figure 10:
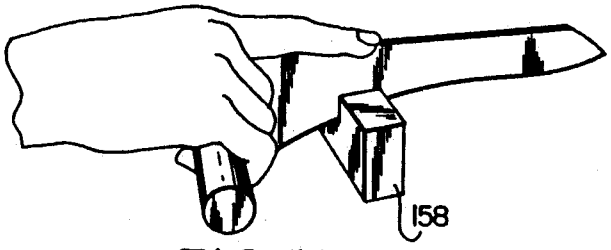
FIG. 10 illustrates use of the steeling jig 158 from FIG. 1.

FIG. 10 illustrates how an operator uses a steeling jig 158 to remove burrs. Simultaneously, the steeling jig hones the edge.

Figure 11:
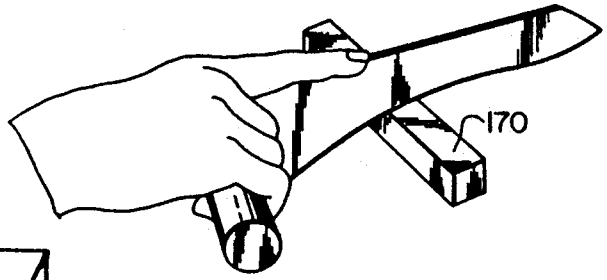
FIG. 11 illustrates use of the wiping block 170 of FIG. 1.

FIG. 11 illustrates the manner in which an operator may wipe any remaining burrs on the wiping block 170. Preferably, wiping block 170 is a long thin block of wood, such as pine.

Modifications and variations of the above-described embodiments of the present invention are possible, as appreciated by those skilled in the art in light of the above teachings. For example, variations of the angle of incidence of the blade on the abrasive surface may be implemented by altering the orientation of the guide plate with respect to the axis of the drum. Similarly, other means of maintaining a proper, adjustable amount of tension of the blade tensioning assembly may be practiced. It is therefore to be understood that, within the scope of the appended claims and their equivalents, the invention may be practiced otherwise than as specifically described.

What is claimed is:

1. A blade sharpening system for sharpening a blade, the blade having an edge to be sharpened, the system comprising:

(a) a motor;

(b) a movable structure, connected to the motor;

(c) an abrasive medium, fit to a surface of the movable structure; and (d) a guide structure, disposed with respect to the movable structure to allow substantially consistent repeatable positioning of the blade with respect to the abrasive medium so that a contact area between the edge of the blade and the abrasive medium remains substantially constant regardless of the amount of use of the abrasive medium;

wherein the guide structure is a substantially rigid planar member oriented with respect to an axis of the movable structure:

(1) by an angle $\phi$ in a first plane, in which $\phi$is not 0° or 90°, and (2) by an angle $(90-\theta)$ in a second plane, in which $\theta$ is not 0° or 90°; and wherein the angles $\phi$ and $\theta$ substantially define the contact area between the edge of the blade and the abrasive medium by defining an orientation of the blade on the guide structure as the blade is brought into contact with the abrasive medium.

2. The system of claim 1, wherein:

the movable structure includes a rotatable drum which the motor rotates; and the abrasive medium includes a hollow cyclindrical sheet having an abrasive outer surface.

3. The system of claim 2, wherein:

the drum includes a plurality of sectors defined by slots extending along the drum parallel to an axis of the drum; and the system further comprises a plug structure for insertion into the drum for moving the sectors apart f rom each other so that a radial dimension of the drum is increased with the plug structure's insertion, gripping the abrasive medium more tightly.

4. The system of claim 3, wherein:

the drum includes a threaded aperture concentrically aligned with the axis of the drum; and the plug structure comprises a threaded cylindrical structure for insertion into the drum's threaded aperture.

5. The system of claim 1, wherein:

the angle $\phi$ is approximately equal to 23°;

the first plane is a substantially vertical plane;

the angle $\theta$ is approximately equal to 38°;

the second plane is a substantially horizontal plane; and the movable structure is a drum including the axis oriented downward at an angle substantially equal to the angle $\phi$.

6. The system of claim 1, further comprising:

a base for supporting the motor; and a wiping block, attached to the base, for removing burrs from the blade after a sharpening process.

7. The system of claim 1, further comprising:

a base for supporting the motor; and a wiping block, attached to the base, for removing burrs from the blade after a sharpening process.

8. The system of claim 1, further comprising:

a blade clamp adapted to removably attach the blade to a blade handle.

9. A blade sharpening system for sharpening a blade, the blade having an edge to be sharpened, the system comprising:

a) a motor;

a movable abrasive medium, operatively connected with the motor, for contacting the edge of the blade during a sharpening operation;

c) a guide structure for allowing positioning of the blade during the sharpening operation; and d) a tensioner assembly for reducing blade chatter, the tensioner assemble including:

1) a tensioning foot, movable oriented with respect to the guide structure, and contacting the blade at a tensioning area on respective facing surfaces of the tensioning foot and the blade, the tensioning foot's facing surface being flat and made of a firm but not hard material so as to firmly apply tension to the blade's facing surface throughout the tensioning area without damaging the blade's edge; and 2) an adjusting assembly which adjustably applies force to the tensioning foot for applying force against the blade in the direction of the guide structure.

10. The sharpening system according to claim 9, wherein:

a) the tensioner assembly further includes a tensioner support oriented so as to be substantially stationary with respect to the guide structure; and b) the adjusting assembly includes:

1) at least one slide guide affixed to the tensioning foot and sliding through at least one corresponding aperture in the tensioner support;

2) at least one spring for applying force to the tensioning foot so as to force the tensioning foot in the direction of the guide structure; and 3) a screw including a shaft and a cap, the shaft affixed to the tensioning foot and penetrating an aperture in the tensioner support, the cap limiting the degree to which the at least one spring can move the tensioning foot.

11. The system of claim 9, further comprising:

a base for supporting the motor; and a steeling jig, attached to the base, for removing burrs and honing the edge of the blade after a sharpening process.

12. The system of claim 9, further comprising:

a base for supporting the motor; and a wiping block, attached to the base, for removing burrs from the blade after a sharpening process.

13. The system of claim 9, further comprising:

a guide structure cover attached to the guide structure and disposed between the guide structure and the tensioning foot, the guide structure provided with plural parallel visual guidelines for visual alignment of the blade with respect to the abrasive medium during a sharpening process.

14. The system of claim 9, further comprising:

a blade clamp adapted to removably attach the blade to a blade handle.

15. A blade sharpening system for sharpening a blade, the blade having an edge to be sharpened, the system comprising:

a) a motor;

b) a rotatable drum, wherein:

1) the drum has an axis connected to the motor for rotating the drum;

2) the drum's axis projects downward from horizontal at an angle $\phi$ approximately equal to 23°;
3) the drum has a substantially cylindrical outer surface;
4) the drum includes a plurality of drum sectors separated from each other by slots; and
5) the drum includes a threaded aperture concentrically positioned with the drum axis;

c) a hollow substantially cylindrical sheet having an abrasive outer surface, the sheet disposed about the drum at its outer surface;

d) a substantially cylindrical threaded drum plug for insertion into the drum's threaded aperture, for moving the drum sectors apart from each other so that a radial dimension of the drum is increased with the plug's insertion, gripping the cylindrical sheet more tightly;

e) a substantially planar guide plate oriented substantially horizontally, the guide plate disposed with respect to the drum to allow substantially consistent repeatable positioning of the blade with respect to the sheet so that a contact area between the edge of the blade and the sheet remains substantially constant regardless of the amount of use of the sheet;

f) a substantially planar guide plate cover, affixed to a top surface of and parallel to the guide plate, the guide plate cover including plural visual guide lines, the guide plate oriented so that the guide plate cover's guide lines are oriented at an angle $(90-\theta)$ with respect to a projection of the drum axis on the horizontal plane, the angle $\theta$ approximately equal to 38°;

g) a tensioner assembly for reducing blade chatter, the tensioner assembly including:
1) a tensioner support oriented so as to be substantially stationary with respect to the guide plate;
2) a tensioning foot movably oriented with respect to the tensioner support via an assembly including:
i) at least one slide guide affixed to the tensioning foot and sliding through apertures in the tensioner support;
ii) at least one spring for applying force between the tensioner support and the tensioning foot so as to force the tensioning foot in the direction of the guide plate cover; and
iii) a screw including a shaft and a cap, the shaft affixed to the tensioning foot and penetrating an aperture in the tensioner support, the cap adjustably limiting the degree to which the at least one spring can move the tensioning foot;

h) a base for supporting the motor;

i) a blade clamp adapted to removably attach the blade to a blade handle;

a steeling jig, attached to the base, for removing burrs and honing the edge of the blade after a sharpening process; and k) a wiping block, attached to the base, for removing burrs from the blade after the sharpening process.

* * * * *